US005937458A

United States Patent [19]

DeRosa

[11] Patent Number: 5,937,458

[45] Date of Patent: Aug. 17, 1999

[54] CRIB BUMPER SAFETY SYSTEM

[76] Inventor: Susan Fracasso DeRosa, 136 Linden Ave., Verona, N.J. 07044

[21] Appl. No.: 09/050,154

[22] Filed: Mar. 30, 1998

[51] Int. Cl.[6] ..... A47D 15/00; A47D 7/00; A47D 21/00

[52] U.S. Cl. ..... 5/424; 5/946

[58] Field of Search ..... 5/93.1, 946, 424, 5/663, 922

[56] References Cited

U.S. PATENT DOCUMENTS

| | | | |
|---|---|---|---|
| 2,128,978 | 9/1938 | Akin | 5/946 |
| 3,018,492 | 1/1962 | Rosen | 5/946 |
| 3,321,779 | 5/1967 | Kaufman et al. | 5/93.1 |
| 3,619,824 | 11/1971 | Doyle | 5/946 |
| 3,877,090 | 4/1975 | Schutz | 5/93.1 |
| 4,370,765 | 2/1983 | Webber | 5/482 |
| 5,410,765 | 5/1995 | Dicken | 5/424 |
| 5,421,046 | 6/1995 | Vande Streek | 5/663 |
| 5,542,135 | 8/1996 | Ozrovitz et al. | 5/424 |
| 5,577,276 | 11/1996 | Nicholson et al. | 5/424 |
| 5,806,112 | 9/1998 | Harms | 5/424 |

*Primary Examiner*—Alex Grosz

*Attorney, Agent, or Firm*—Anthony J. Casella; Gerald E. Hespos; Ludomir A. Budzyn

[57] ABSTRACT

A crib bumper assembly is provided. The crib bumper assembly includes a bottom panel to be positioned between the spring and mattress of a crib. The crib bumper assembly further includes head, foot and side panels articulated to and extending upwardly from the bottom panel. Portions of these panels adjacent the bottom panel will lie in abutting face-to-face engagement with the head, foot and side surfaces of the mattress. The head, foot and side panels extend upwardly from the top surface of the mattress and are formed to include padding. Ties or other such attachments are secured to head, foot and side panels for attachment to spindles or other such structures on the crib.

5 Claims, 6 Drawing Sheets

CRIB BUMPER SAFETY SYSTEM

BACKGROUND OF THE INVENTION

1. Field of the Invention

The subject invention relates to safety bumpers for a crib.

2. Description of the Prior Art

An infant's crib includes a head board, a foot board and a pair of sides extending between the head board and foot board. The sides typically are formed with a pair of horizontal rails connected to one another by a plurality of vertically aligned spindles disposed in spaced parallel relationship to one another. The spacing between the spindles permits a flow of air through the region of the crib and enables the parent to observe the child. Furthermore, the spindles in the sides of the crib enable the infant to view the surrounding room. Spindles also are provided in the head board and foot board of some prior art cribs. Additionally, some prior art cribs include corner posts attached to the head board and foot board, and panels that are spaced inwardly from the corner posts at all locations accept the extreme top and bottom of the respective panels.

The prior art crib further includes a spring that is rigidly connected to the opposed head board and foot board. The spring may have locking mechanisms attached thereto for permitting selective raising and lowering of at least one side of the crib. A typical prior art locking mechanism includes a foot actuated latch that can be released to enable the selective lowering of a side of the crib. The latch will engage the side of the crib automatically when the side is raised to its maximum height.

The prior art crib further includes a rectangular mattress supported on the spring. The mattress extends substantially entirely between the opposed head board and foot board and between sides of the crib. The typical prior art mattress for a crib is manufactured with a plastic waterproof outer cover. The plastic cover would be uncomfortable and potentially unsafe for the infant. Consequently, the prior art crib mattress invariably is used with a sheet. Most prior art crib mattresses are used with fitted sheets that have elastic at selected edge locations. The fitted sheet is configured and dimensioned to effectively envelop the top, sides and ends of the mattress and to engage a small portion of the bottom of the mattress. The prior art fitted sheet typically is mounted by at least partly removing the prior art mattress from the crib so that the elastic edges of the fitted sheet can be efficiently engaged under the mattress.

The spacing of openings in the sides and ends of a crib are small enough to prevent the infant's head from being trapped between adjacent spindles. However, an infant's arm or leg easily can be passed through the spaces between the spindles. Forces exerted by the slats on an arm or leg inadvertently slipped into the space between the spindles can affect the flow of blood to the infant's limb, and thereby can cause permanent damage. In other situations, an infant may injure an arm or leg joint by attempting to turn or roll while a limb is extended between the spindles. In still other situations, a curious infant may catch a finger or toe in the spring or locking mechanism directly beneath the mattress. Still other injuries can occur by contact when the infant rolls or falls into a hard spindle.

In view of these potential problems, most parents utilize a crib bumper. The typical prior art crib bumper is an elongate series of pads disposed in end-to-end relationship. Each pad is approximately 0.5–1.0 inch thick and approximately 10 inches high. Two of the pads have lengths substantially equal to the length of the crib mattress, while two other pads have lengths substantially equal to the width of the crib mattress. The pads of the prior art crib bumper alternate such that long pads are in end-to-end relationship with short pads. The pads are enveloped in an attractive cover that functions to retain the pads in end-to-end relationship. A plurality of strings or ribbons are sewn to the cover at selected locations along at least one edge. More particularly, strings or ribbons typically are sewn near midpoints of the longer pads and at the connections between adjacent pads. The interconnected pads are inserted into the crib and are articulated relative to one another such that the long pads lie adjacent the sides of the crib and such that the short pads lie adjacent to the head board and foot board. The strings or ribbons then are employed to tie the pads of the prior art bumper to the spindles of the crib.

Prior art crib bumpers of this type have been used for generations. However, these prior art crib bumpers are not perfect and room for improvement exists. For example, the above-described prior art crib bumper easily can move upwardly relative to the spindles, thereby leaving a gap between the bottom of the bumper and the top of the mattress. The infant's arm or leg easily can be inserted into the gap between the spindles, thereby permitting the problems described above. Additionally, the functioning of the prior art crib bumper is contingent upon the secure retention of the strings or ribbons on the spindles. An inadvertent loosening or a pulling of the ribbon by a curious infant can lead to a complete collapse and disassembly of the prior art crib bumper.

The above-described prior art crib bumper also is aesthetically undesirable in many respects. For example, the outer face of the crib bumper is disposed substantially adjacent portions of the crib sheet that cover the sides of the mattress. Crib sheets must be laundered frequently and have a very short life span. Thus, to achieve aesthetic attractiveness of the crib, the parent or guardian must shop for crib sheets that match or coordinate with the design or color on the crib bumper. Furthermore, the gap between the bumper and the mattress contributes to the aesthetic unattractiveness.

The prior art includes various attempts to provide improved crib bumpers. For example, U.S. Pat. No. 3,321,779 shows a crib mattress with integral pads. The pads are hingedly connected to the edges defined by the lower face of the mattress and the side faces thereof. The pads all are dimensioned to extend upwardly beyond the top face of the mattress when portions of the pads lie in face-to-face contact with the sides and ends of the mattress. This structure necessarily requires a specially manufactured crib mattress that is dimensionally smaller than the conventional mattress so that the combined mattress and bumper assembly can fit within the fixed dimensions of the crib. Additionally, this prior art assembly virtually precludes the use of the conventional crib sheets that are fitted to engage under portions of the mattress adjacent the sides and ends of the mattress.

U.S. Pat. No. 3,619,824 shows a combined bumper and sheet assembly. More particularly, the bottom edge of the crib bumper is affixed to portions of the sheet that will lie adjacent the outer periphery of the crib mattress. The sheet further includes a portion extending downwardly to lie adjacent the side faces of the crib mattress. This prior art structure necessarily requires a crib bumper to be changed each time the sheet has changed. Prior art bumpers of this type may make it difficult for the infant to insert an arm or leg between the spindles of the crib. However, normal movement of the infant on the mattress may cause the bumper to raise, thereby contributing to the aesthetic unattractiveness described above.

U.S. Pat. No. 3,877,090 shows a bumper assembly with downwardly depending straps that can be secured to the spring or to some other structural element below the mattress. This design may prevent upward separation of the bumper from the crib mattress. However, the straps for securing the bumper to lower portions of the crib structure are unsightly and further detract from the appearance of the crib at the interface between the bumper and portions of the sheet adjacent the side faces of the mattress.

U.S. Pat. No. 5,410,765 shows a crib bumper assembly similar to the conventional prior art crib bumper described in detail above. However, the crib bumper of U.S. Pat. No. 5,410,765 further includes downwardly extending flaps to lie adjacent the side faces of the crib mattress. This prior art crib bumper can move upwardly relative to the mattress to create the problems described above.

U.S. Pat. No. 5,542,135 shows a crib bumper that attempts to overcome the problems described with the bumper referred to in the preceding paragraph and with the conventional prior art crib bumper discussed above. In this regard, U.S. Pat. No. 5,542,135 shows a foam crib bumper formed to include an inwardly facing notch dimensioned to engage the side faces of the crib mattress. Thus, portions of the crib bumper below the notch will lie beneath the bottom surface of the crib mattress, while portions of the foam bumper above the notch will lie above the top face of the crib mattress. The depth or thickness provided at the notch exceeds the normal distance between the side or end faces of the mattress and the side or end faces of the mattress and the sides, head board and foot board of the crib. Thus, the bumper assembly shown in U.S. Pat. No. 5,542,135 could require a special mattress. Additionally, a bumper of this type could be hard to assemble and could complicate the frequent sheet-changing.

U.S. Pat. No. 4,370,765 shows a crib bumper that wraps entirely over the sides of the crib. The bottom portions of the bumper are tied to the spring or other structural elements beneath the bottom of the mattress.

U.S. Pat. No. 5,577,276 shows a complex assembly where a crib bumper includes a plurality of vertically extending side and end walls interconnected consecutively to one another and dimensioned such that portions of these bumper side walls lie adjacent the side and end faces of the mattress, while portions of the bumper extend considerably upwardly from the top face of the mattress. The bumper assembly shown in U.S. Pat. No. 5,577,276 is used with a sheet having portions lying on the top face of the mattress, and portions extending upwardly in substantially face-to-face engagement with the bumper. Top flaps of the bumper then are folded downwardly and over the upwardly extending walls of the sheet. This unusual arrangement requires specially manufactured sheets. Without such specially manufactured sheets, the bumper can easily lift relative to the mattress, thereby creating the problems referred to above.

SUMMARY OF THE INVENTION

The subject invention is directed to a crib safety bumper assembly for use with a crib having a spring and a mattress. The crib includes a head board, a foot board disposed in parallel spaced relationship to the head board and a pair of spaced apart parallel sides extending between the head board and foot board. A spring extends orthogonally between the head board, foot board and sides. A mattress is positionable on the spring, and also lies between the head board, foot board and sides of the crib.

The mattress may be of conventional size and shape for a crib mattress. More particularly, the mattress may include a rectangular top surface having parallel head and foot edges that are spaced apart by a distance that defines a length for the mattress. The top surface of the mattress further may include first and second side edges that extend between the head and foot edges. The side edges of the top surface are spaced apart by a distance that defines the width for the mattress. The mattress may include a bottom surface that is substantially identical to the top surface. More particularly, the bottom surface of the mattress includes parallel head and foot edges and first and second side edges.

The mattress further includes a head end surface that extends substantially orthogonally between the head edges of the top and bottom surfaces. Similarly, a foot end surface extends between and connects the foot edges of the respective top and bottom surfaces of the mattress. First and second side surfaces extend between the head end surface and the foot end surface. Additionally, first and second side surfaces extend orthogonally between the top and bottom surfaces of the mattress. The head end surface, the foot end surface and the first and second side surfaces are of a substantially equal width that defines the thickness of the mattress. Of course non-rectangular (e.g., round) crib mattresses could be provided. However, all such mattresses would include substantially identical top and bottom surfaces and side surfaces extending therebetween.

The crib bumper assembly of the subject invention includes a bottom panel with a size and shape conforming to the size and shape of the bottom surface of the mattress. For the standard rectangular mattress, the crib bumper assembly includes a substantially rectangular bottom panel with opposed parallel head and foot ends that are dimensioned substantially equal to the width of the crib mattress. The bottom panel of the crib bumper assembly for a rectangular mattress further includes substantially parallel first and second sides that edges extending orthogonally between the head and foot ends. The first and second sides of the bottom panel define a length that is dimensionally substantially equal to the length of the crib mattress.

Head and foot panels are articulated to the bottom panel of the crib bumper assembly along the respective head and foot ends thereof. The head and foot panels define lengths substantially equal to the width of the bottom panel and extend from the bottom panel distances that exceed the thickness of the crib mattress, as explained in greater detail below.

First and second side panels are articulated to the bottom panel of the crib bumper assembly along the respective first and second sides of the bottom panel. The first and second side panels define lengths substantially equal to the length of the bottom panel, and therefore substantially equal to the length of the mattress. Opposed ends of the first and second side panels are connected to the opposed ends of the head and foot panels to define corners. The first and second side panels extend from the bottom panel distances that exceed the thickness of the crib mattress and that preferably equal the extent of the head and foot panels from the bottom panel.

The crib bumper assembly further includes a plurality of bumper pads that are enveloped by portions of the head, foot and side panels spaced from the bottom panel. More particularly, the crib bumper assembly includes a head bumper pad and a foot bumper pad each of which defines a length substantially equal to the width of the mattress. The width and thickness of the head and foot bumper pads may vary in accordance with preference of the user or manufacturer. Preferably, the head and foot bumper pads define equal widths of approximately ten inches and define equal thicknesses of approximately one half inch to one inch. The bumper pad further include first and second side bumper pads which define lengths substantially equal to or slightly less than the length of the mattress. The first and second side bumper pads preferably define widths and thicknesses substantially equal to the widths and thicknesses of the head and foot bumper pads.

The bumper pads are enveloped in the respective head, foot and side panels at locations that are spaced from the bottom panel by distances substantially equal to the thickness of the mattress. More particularly, portions of the respective head, foot and side panels of the crib bumper assembly are folded over the corresponding bumper pads. Edges of the respective head, foot and side panels remote from the bottom panel then are secured to locations on the corresponding panels.

The crib bumper assembly of the subject invention further includes a plurality of fasteners for releasably fastening the assembly to the crib. The fasteners may include ties for tying portions of the crib bumper assembly to the spindles of the crib. Alternatively, other attachment means may be provided, such as flaps or tabs with means for releasable attachment around the spindles of the crib.

The crib bumper assembly of the subject invention is used by initially removing the mattress from the crib. The bottom panel of the bumper assembly then is positioned on the spring. The head and foot panels and the side panels with the bumper pads enveloped therein then are aligned substantially orthogonally to the spring to extend in substantially face-to-face relationship with the respective head and food boards and the sides of the crib. The structural integrity of the bumper pads provides the necessary support for this initial positioning of the crib bumper assembly. The mattress then is placed back in the crib and is urged downwardly toward the spring. The head and foot panels and the side panels with the bumper pads enveloped therein are pulled upwardly as the mattress is being urged downwardly. Inherent resiliency and flexibility of the mattress and the bumper pads enables this positioning to be completed without difficulty.

Upon final positioning, the bottom panel of the crib bumper assembly will lie between the spring and the bottom surface of the crib and mattress. More particularly, the bottom panel of the crib bumper assembly will lie in face-to-face engagement with the bottom surface of the crib mattress. Portions of the head and foot panels between the bottom panel and the bumper pads will lie in face-to-face engagement with the head and foot end surfaces of the mattress and between the mattress and the respective head and foot boards of the crib. Similarly, portions of the side panels of the crib bumper assembly between the bottom panel and the bumper pads will lie in face-to-face engagement with the respective side surfaces of the crib mattress and between the crib mattress and the respective sides of the crib.

The bumper pads will extend upwardly from the top surface of the mattress. More particularly, the head bumper pad will extend upwardly from the head edge of the top surface of the mattress and will be substantially adjacent the head board of the crib. Similarly, the foot bumper pad will extend upwardly from the foot edge of the top surface of the mattress and will lie in face-to-face engagement with the foot board of the crib. The side bumper pads will extend upwardly from the side edges of the top surface of the mattress and will lie substantially adjacent the respective sides of the crib. The attachment means then may be secured to the spindles of the crib.

The crib bumper assembly of the subject invention securely protects the infant from forceful contact with the spindles, head board, foot board or other hard parts of the crib. Additionally, the crib bumper assembly of the subject invention prevents the infant from sticking an arm or leg through the space between adjacent spindles of the crib. In this regard, the secure connection of bumpers to the side panels and the secure connection of the side panels to the bottom panels prevents the bumper pads from being raised from the level of the mattress sufficiently to permit the infant to pass an arm or leg beneath the bumper pads and through the space between adjacent spindles. Furthermore, portions of the side panels extending continuously from the bumper pads to the bottom panel of the crib bumper assembly further prevent the infant from squeezing an arm downwardly through the space between the spindles.

The crib bumper assembly of the subject invention further provides a very desirable aesthetic appearance with a continuous material extending along the side surfaces of the crib mattress and along the bumper assembly. Furthermore, the connection between the side panels and the bottom panel prevents portions of the crib bumper assembly from sliding upwardly and into a position where portions of the mattress are visible.

The crib bumper assembly does not significantly impede the changing of sheets. More particular, sheets may be changed in the conventional manner by merely lifting up one side of the mattress to remove the soiled sheet and to attach the clean fitted sheet. The side of the mattress then is urged downwardly into face-to-face contact with the bottom panel of the crib upper assembly and into supporting engagement with the spring. The opposed side of the mattress then is lifted up. Removal of the soiled sheet is completed and the free half of the clean fitted sheet then is attached to the mattress. This remaining side of the mattress then is urged downwardly into face-to-face contact with the bottom panel of the crib upper assembly and into supporting engagement with the spring.

DETAILED DESCRIPTION OF THE PREFERRED EMBODIMENT

Figure 1:
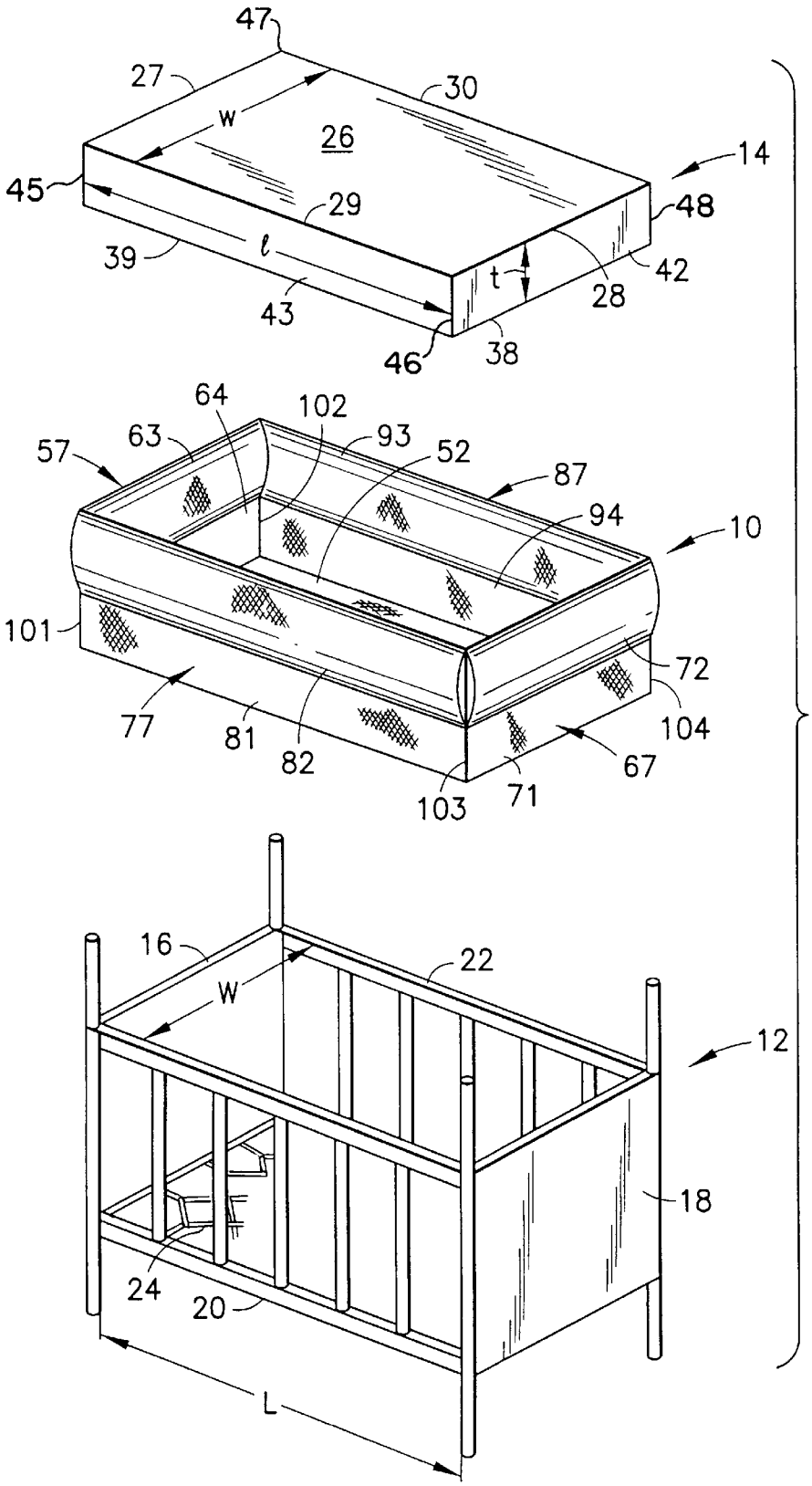
FIG. 1 is an exploded perspective view of a crib, mattress and crib bumper assembly in accordance with the subject invention.
Figure 2:
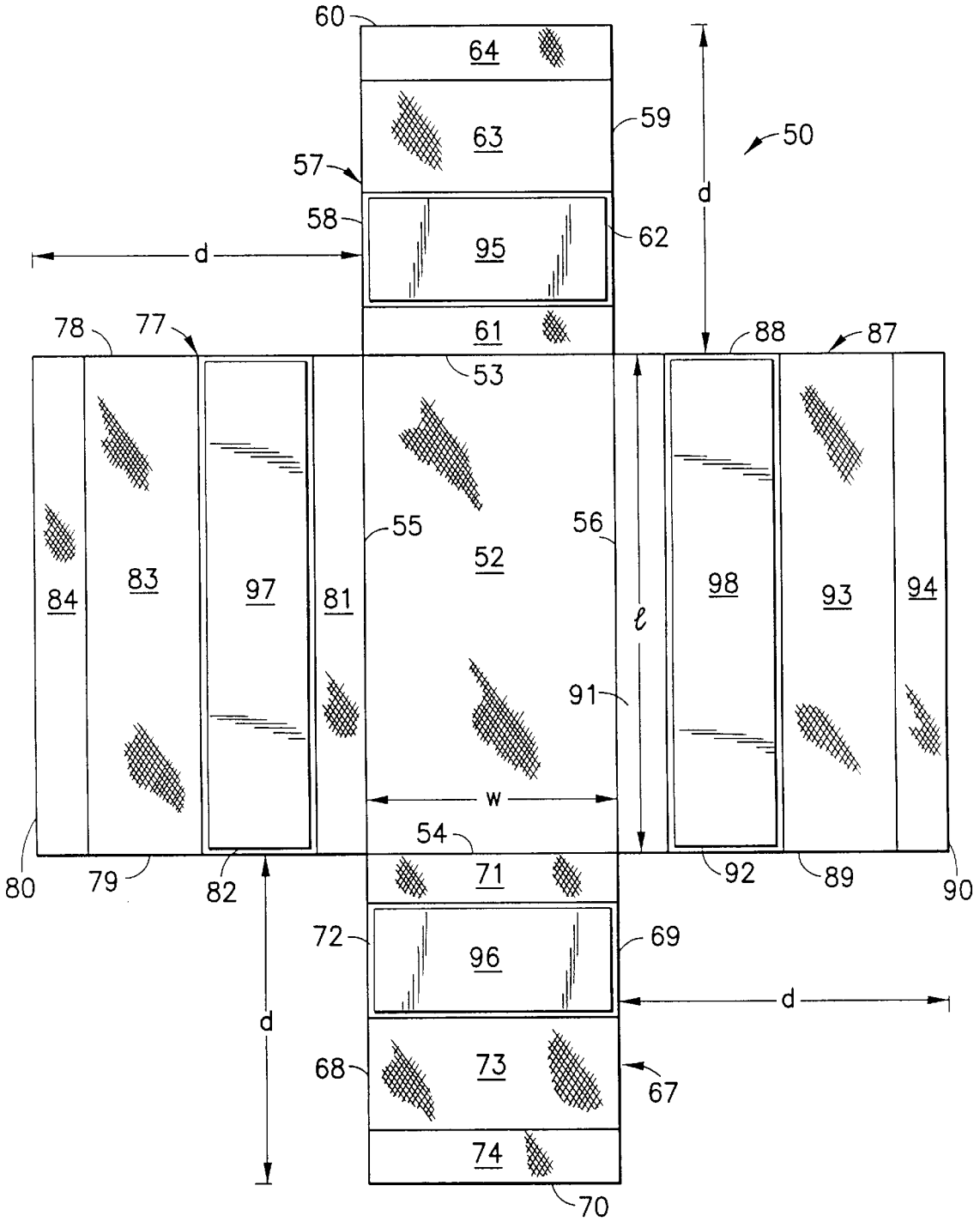
FIG. 2 is a top plan view of partly manufactured panels and bumper pads for the crib bumper assembly.
Figure 3:
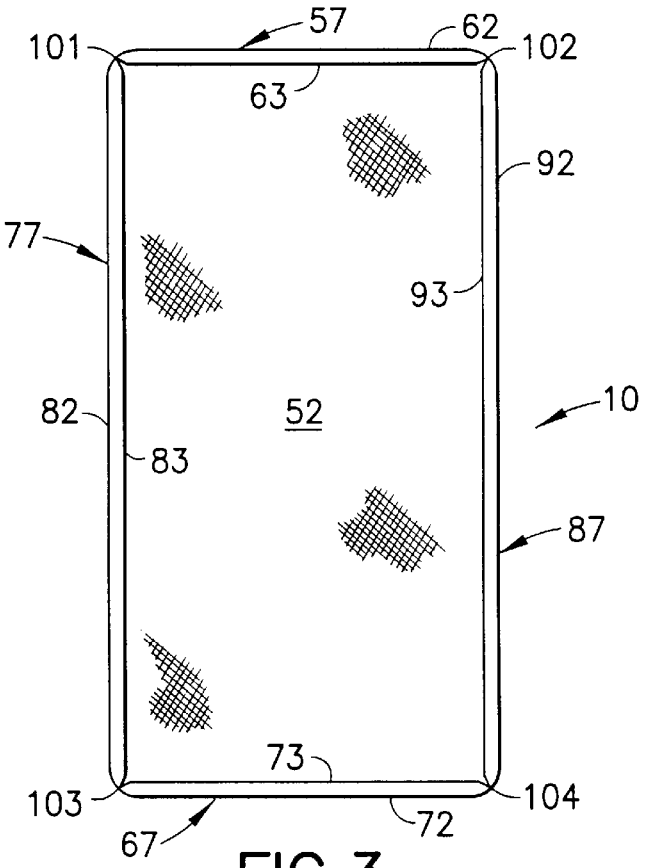
FIG. 3 is a top plan view of a fully manufactured crib bumper assembly.
Figure 4:
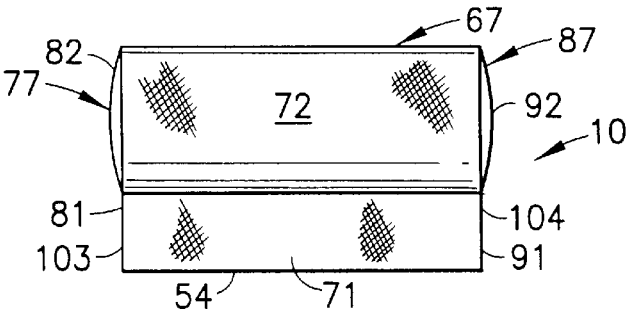
FIG. 4 is a side elevational view of the crib bumper assembly shown in FIG. 3.

A crib bumper assembly in accordance with the subject invention is identified generally by the numeral 10 in FIG. 1. The crib bumper assembly is used with a crib 12 and a mattress 14. The crib 12 includes a head board 16, a foot board 18 and first and second sides 20 and 22 respectively. The head board 16 and foot board 18 are substantially parallel and are spaced from one another by a distance "L" of slightly greater than 50 inches. The first side 20 at the second side 22 also are parallel and are spaced from one another by a distance "W" slightly greater than 25 inches. The distances "L" and "W" preferably conform to standard dimensions for a crib. A spring 24 is supported orthogonally between the head board 16, foot board 18 and sides 20 and 22. At least one of the first and second sides 20 and 22 may be movable vertically relative to the head board 16, foot board 18 and spring 24. A latch (not shown) may be mounted to the spring for releasably holding the side in an upper most position.

The mattress 14 includes a rectangular top surface 26 having a top head edge 27, a top foot head edge 28 and first and second top side edges 29 and 30. The top head and foot edges 27 and 28 are spaced from one another at a distance "l" which preferably equals 50 inches. The first and second top side edges 29 and 30 preferably are spaced from one another by a distance "w" which preferably equals 25 inches.

The mattress 14 further includes a rectangular bottom surface 36 which is parallel to the top surface 26 and which is spaced from the top surface 26 by a distance "t" of about six inches. The bottom surface 36 is defined by a bottom head edge 37, and a bottom foot edge 38 which are parallel to one another and spaced by the distance "l". The bottom surface 36 further is defined by first and second bottom side edges 39 and 40 which are parallel to one another and spaced apart by the distance "w".

The mattress 26 further includes a head surface 41 and a foot surface 42 which are disposed in spaced parallel relationship to one another. The head surface 41 extends between and connects the top and bottom head edges 27 and 37. Similarly, the foot surface 42 extends between and connects the top and bottom foot edges 28 and 38. First and second side surfaces 43 and 44 also extend between and connect the top and bottom surfaces 26 and 36. More particularly, the first side surface 43 extend from the first top side edge 29 to the first bottom side edge 39. Additionally, the first side surface 43 extends from the head surface 41 to the foot surface 42 and defines corner edges 45 and 46 respectively. Similarly, the second side surface 44 extends between and connects the second top and bottom side edges 30 and 40. Additionally, the second side surface 44 extends from the head and foot surfaces 41 and 42 at corner edges 47 and 48.

The crib bumper assembly 10 is formed from a panel blank 50. The panel blank 50 may be a unitary piece of fabric or may be formed from a plurality of separate pieces that are securely sewn together. The blank 50 includes a bottom panel 52 having head and foot fold lines 53 and 54 and first and second side fold lines 55 and 56 respectively. The head and foot fold lines 53 and 54 are spaced apart a selected distance which defines a length "l" for the bottom panel 52 that is substantially equal to the length "l" of the mattress 14. The first and second side fold lines 55 and 56 of the bottom panel 52 a selected distance which defines a width "w" for the bottom panel 52 substantially equal to the width "w" of the mattress 14.

The blank 50 includes a head panel 57 articulated to the bottom panel 52 along the head fold line 53. The head panel 57 is substantially rectangular and includes sides 58 and 59 extending substantially colinearly from the fold lines 55 and 56 respectively. Additionally, the head panel 57 includes an edge 60 that extends substantially parallel to the fold line 53. The edge 60 is spaced from the fold line 53 by a distance "d" such that "d">2h+t, where "h" is approximately equal to the desired height for the crib bumper above the mattress 14. In a preferred embodiment, "d"≧2h+2t. The head panel 57 may be considered to include four separate sections, namely, an outer mattress head portion 61, an outer pad head portion 62, an inner pad head portion 63 and an inner mattress head panel 64.

The blank 50 further includes a substantially rectangular foot panel 67 which is articulated to the bottom panel 52 along the foot fold line 54. The foot panel 67 includes side edges 68 and 69 which extend colinearly from the side fold lines 55 and 56 respectively. Additionally, the foot panel 67 includes an edge 70 extending parallel to the fold line 54 and spaced therefrom a distance "d". The foot panel 67 includes narrow rectangular regions 71–74 substantially identical to regions on the head panel 57.

The blank 50 further includes a substantially rectangular first side panel 77 articulated to the bottom panel 52 along the first side fold line 55. The first side panel 77 includes edges 78 and 79 that extend colinearly from the fold lines 53 and 54. An edge 80 extends parallel to the fold line 55 at the distance "d" therefrom. The first side panel 77 includes narrow rectangular regions 81–84 having widths substantially as described with respect to the regions 61–64 of the head panel 57.

Finally, the blank 50 includes a second side panel 87 having edges 88 and 89 that extend colinearly from the fold lines 53 and 54. An edge 90 of the second side panel 87 extends parallel to the fold line 56 and at a distance "d" therefrom. The second side panel 87 further includes elongate rectangular regions 91–94 having widths corresponding substantially to the widths of the regions 81–84 on the first side panel 77.

The bumper assembly 14 further includes a plurality of rectangular padding sections. More particular, the rectangular head padding 95 has a length equal to or slightly less that the width "w" of the mattress 14 and is initially positioned on the rectangular region 62 of the head panel 57. A rectangular foot padding 96 is substantially identical to the rectangular head padding 95, and is positioned on the rectangular region 72 of the foot panel 67. Rectangular first and second side padding sections 97 and 98 are substantially identical to one another and are positioned respectively on the regions 82 and 92 of the first and second side panels 77 and 87. The side padding sections 97 and 98 have lengths equal to or slightly less than the length "l" of the mattress 14. Each of the padding sections 95–98 finds a width of approximately 10 inches and a thickness of approximately one half-one inch.

The manufacturing of the bumper assembly 14 proceeds by rotating regions 63 and 64 of the head panel 57 approximately 180° relative to the regions 62 and 61 thereof such that the edge 60 of the head panel substantially aligns with the fold line 53. Thus, the head padding section 95 lies between the region 62 and 63 of the head panel 57. The head panel 57 then is sewn in this folded condition to define a first seam in proximity to the edge 60 and the fold line 53 and a second seam substantially adjacent the padding 95. The opposed ends of the head panel 57 then are sewn closed to substantially envelope the padding 95 therein. Similar manufacturing is carried out on the foot panel 67 and the first and second side panels 77 and 87.

The manufacturing of the crib bumper assembly 14 may proceed by sewing the edge 58 of the head panel 57 to the edge 78 of the first side panel 77 to define a first head corner 101. Similarly, the edge 59 of the head panel 57 may be sewn to the edge 88 of the second side panel 87 to define a second head corner 102. Comparable manufacturing steps may be carried out near the foot of the crib bumper assembly. More particularly, the edge 68 of the foot panel 67 may be sewn to the edge 79 of the first side panel 77 to define a first foot corner 103. The second edge 69 of the foot panel 67 then may be sewn to the edge 89 of the second side panel 87 to define a second foot corner 104.

Figure 7:
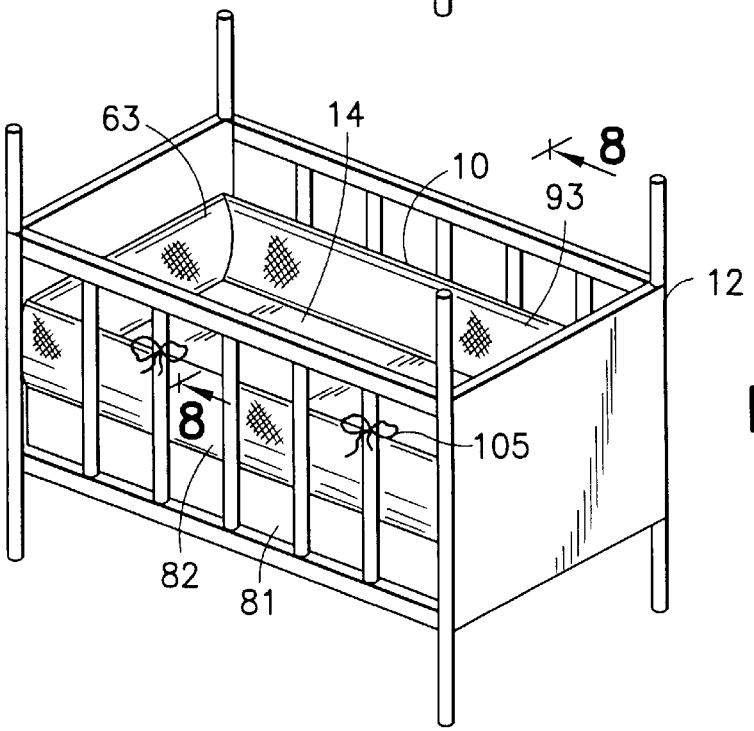
FIG. 7 is a perspective view of the fully assembled crib, bumper and mattress.

Manufacturing may conclude by affixing attachments to crib bumper assembly 14 for secured but releasably attachment to spindles on the crib 12. In the embodiment shown in FIG. 7, the attachments comprise elongate ties 105 made from the same material as the blank 50 or from a coordinating material.

Figure 5:
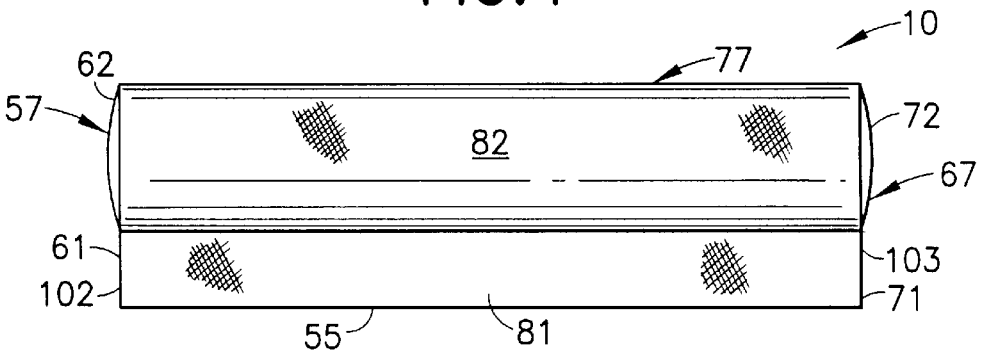
FIG. 5 is an end elevational view of the crib bumper assembly shown in FIGS. 3 and 4.
Figure 6:
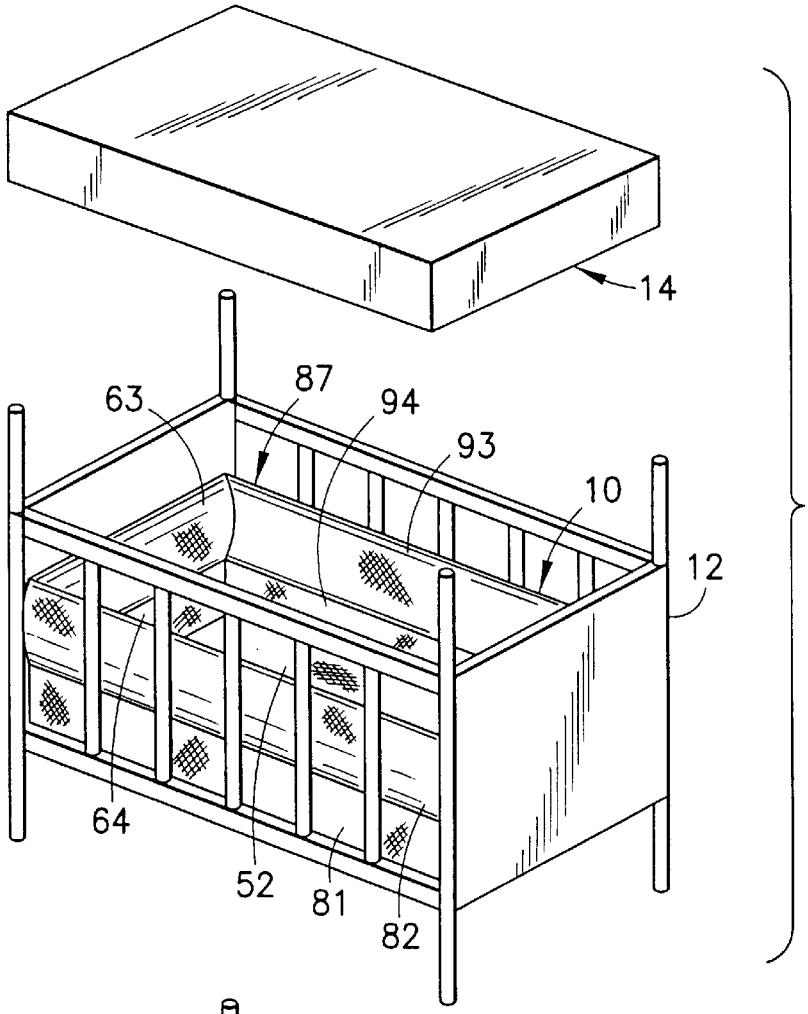
FIG. 6 is an exploded perspective view showing the crib and the bumper assembly in their assembled condition and the mattress in a preassembly disposition relative to the crib.

As shown most clearly in FIGS. 5 and 6, the crib bumper assembly 10 resembles an open-topped box having a length "l", a width "w" and a height of "t+h". The bottom panel 52 and portions of the panels extending distance "t" from the bottom panel 52 are very flexible. Additionally, the corners 101–104 also are very flexible. Portions of the bumper assembly 10 covering the padding 95–98 are less flexible, but nevertheless can be deformed. Thus, the entire bumper assembly can be packaged and stored fairly easily.

The bumper assembly 10 is employed by removing the mattress 14 from the crib 12. The bottom panel 52 of the bumper assembly 10 then is positioned on the spring 24. The head and foot panels 57 and 67 and the side panels 77 and 87 are disposed substantially adjacent the head board 16, the foot board 18 and the sides 20 and 22. Portions of these panels between the padding 95–98 and the bottom panel 52 may collapse toward the bottom panel. However, as flexibility does not impede the initial installation nor the use of the bumper assembly 10.

Figure 8:
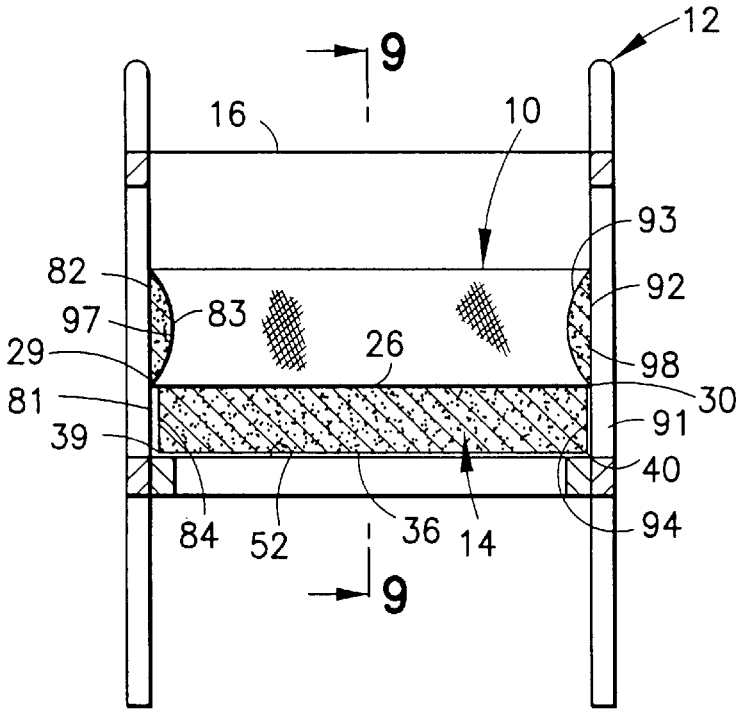
FIG. 8 is a cross-sectional view taken along line 8—8 in FIG. 7.
Figure 9:
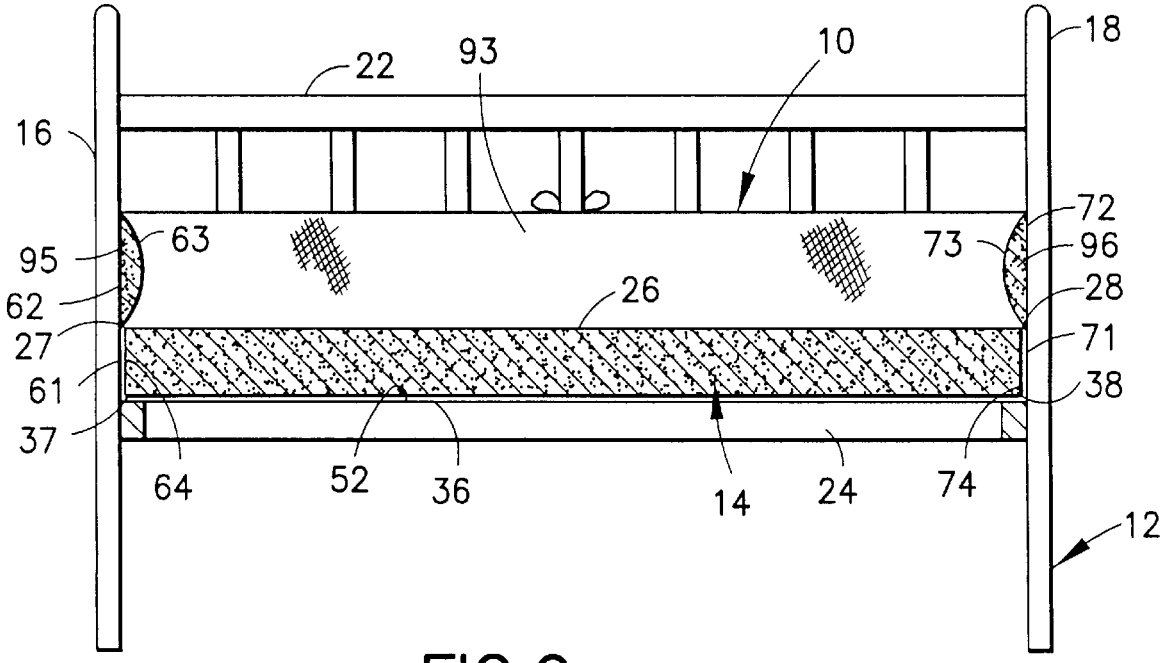
FIG. 9 is a cross-sectional view taken along line 9—9 in FIG. 8.
Figure 10:
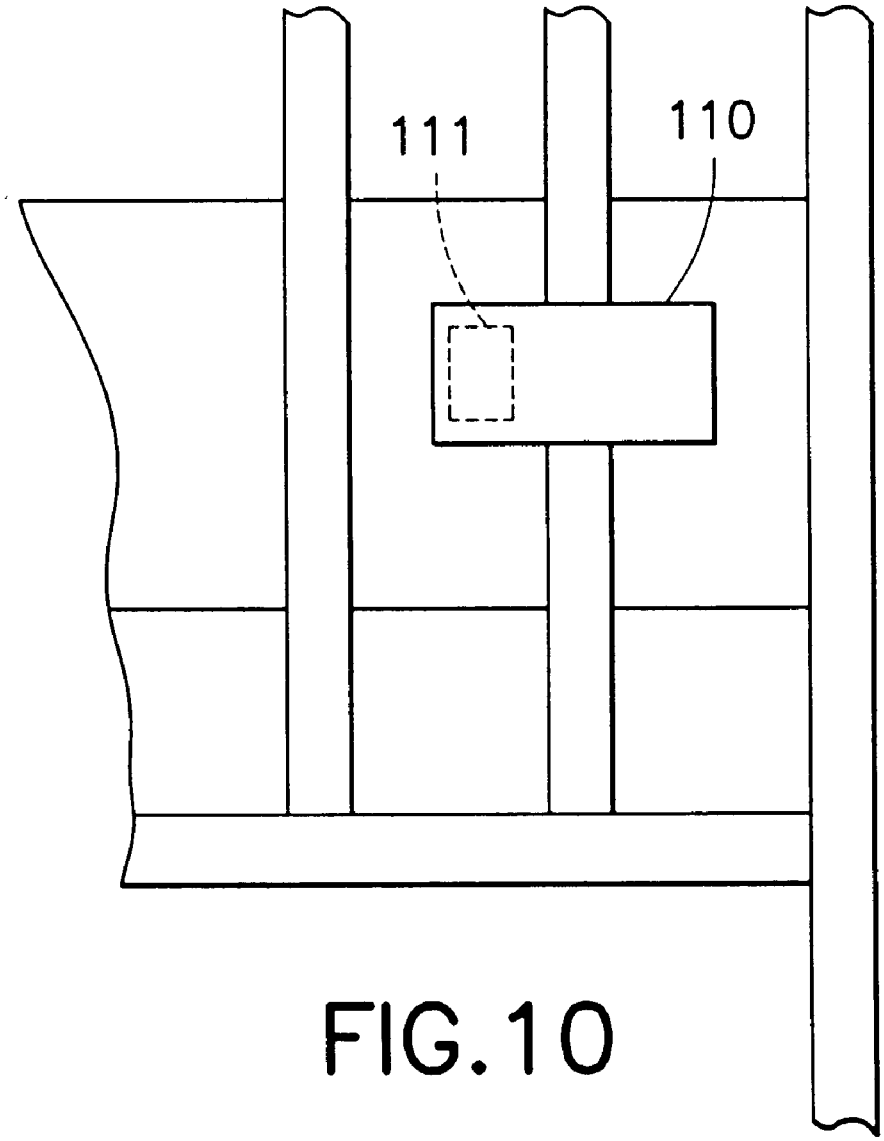
FIG. 10 is a side elevational view showing an alternate attachment for connecting a bumper assembly to the crib.

Installation proceeds by placing the bottom surface 38 of the mattress 14 on the bottom panel 52 of the bumper assembly 10. This typically will require tilting the mattress 14 about one of its sides or ends. For example, the first bottom side edge 39 of the mattress 14 may be positioned on portions of the bottom panel 52 near the first side fold line 55. Portions of the first side panel 77 surrounding the first side padding 97 may then be lifted upwardly while simultaneously urging the bottom side edge 39 of the mattress 14 closer to the first side fold line 55 and while rotating the second side of the mattress 14 downwardly. Upon complete positioning of the bottom surface 38 of the mattress 14 in face-to-face engagement with the bottom panel 52, portions of the side panels may be pulled upwardly to ensure that the padding sections 95–98 are positioned above the top surface 26 of the mattress 14. In this fully installed state, as shown in FIGS. 8 and 9, portion 64 of the head panel 57 will lie adjacent the head surface 41 of the mattress 14. Similarly, the inner head portion 74 of the foot panel 67 will lie adjacent the foot surface 42 of the mattress 14. The inner side portions 84 and 94 of the first and second side panels 77 and 87 will lie respectively adjacent the first and second side surfaces 43 and 44 of the mattress 14. Additionally, in this fully installed condition, the pads will extend a distance "h" above the top surface 26 of the mattress 14.

Installation is completed my merely employing the attachments to secure the bumper assembly to the spindles of the crib 12. As shown in FIG. 9, the attachments comprise ties 105 which are tied to selected spindles. However, an alternate attachment 110 includes a flap and a releasable attachment 111, such as Velcro.

The crib bumper assembly provides several desirable features. Aesthetically, the crib bumper assembly provides a continuous fabric panel extending from a bottom location substantially aligned with the bottom surface 38 of the mattress to a top location at the top of the bumper assembly. Portions of the crib bumper assembly that are articulated to the bottom panel 52 thereof prevent padded portions of the crib bumper assembly from being lifted away from the mattress in a manner that would permit the infant to extend an arm or leg through the space between slats. This connection to the bottom panel further contributes to the aesthetic appearance by avoiding the creation of a gap between the mattress and the padded portions of the bumper assembly.

The preceding paragraphs and figures have shown certain preferred embodiments of the invention. It is apparent, that various changes can be made without departing from the scope of the invention. For example, head, foot and side panels may extend distances greater than or less than those illustrated in the figures. For example, the head, foot and side panels may be sufficiently long to overlap with portions of the bottom panel 52. Additionally, these panels may have a shorter length sufficient to provide only a small overlap beyond the padding and sufficient merely to ensure a secure sewn seam. In other embodiments, the corners 101–104 need not be sewn together. These corner regions may merely be held in proximity to one another by ties or other attachments. In still other embodiments, regions of the blank at the respective corners may include flaps to be overlapped with adjacent panels and sewn in their overlapped condition to provide a more secure corner construction. In still other alternates, the fabric cut from the corners of the blank may be used to form the ties or other such attachment means, thereby ensuring coordination. People skilled in this art also will appreciate that the invention can be adapted to crib mattresses of various non-rectangular shapes, such as round mattresses. These and other changes will be apparent to a person skilled in the art after having read the subject disclosure.

What is claimed is:

1. A crib bumper assembly (10) for use with a crib (12) having spaced apart vertically aligned head and foot boards (16, 18) and spaced apart vertically aligned first and second sides (20, 22) extending between the head and foot boards (16, 18), a substantially horizontally aligned spring (24) secured in the crib (10) between the head and foot boards (16, 18) and between the sides (20, 22) and a mattress (14) having a bottom surface (36) removably positionable on the spring (24), the bumper assembly (10) comprising:

a bottom panel (52) dimensioned and configured for substantially horizontal disposition between the spring (24) and the bottom surface (36) of the mattress (14);

unpadded head and foot panels (61, 71) hingedly articulated to said bottom panel (52) and each extending unitarily from at least a portion of said bottom panel (52), said unpadded head and foot panels (61, 71) being dimensioned for vertical disposition between the mattress (14) and the respective head and foot boards (16, 18) of the crib (12), the unpadded head and foot panels (61, 71) each having opposed first and second side edges (58, 59; 68, 69);

unpadded first and second side panels (81, 91) hingedly articulated to said bottom panel (52) and each extending unitarily from at least a portion of said bottom panel (52), said unpadded first and second side panels (81, 91) each being dimensioned for vertical disposition between the mattress (14) and the respective first and second sides (20, 22) of the crib (12), the unpadded first side panel (81) including head and foot edges (78, 79) securely connected to the first side edges (58, 68) of the unpadded head and foot panels (61, 71), the unpadded second side panel (91) having head and foot edges (88, 89) secured respectively to the second side edges (59, 69) of the respective unpadded head and foot panels (61, 71);

a padded head panel comprising an outer sheet (62) unitarily connected to the unpadded head panel (61) for extending substantially vertically upwardly beyond the mattress (14), an inner sheet (63) unitarily connected to portions of said outer sheet (62) remote from said unpadded head panel (61) and being secured to portions of said outer sheet (62) of said padded head panel adjacent said unpadded head panel (61), a padding material (95) securely disposed between said inner and outer sheets (63, 62) of said padded head panel, said padded head panel having opposed first and second side edges (58, 59);

a padded foot panel comprising an outer sheet (72) unitarily connected to the unpadded foot panel (71) for extending substantially vertically upwardly beyond the mattress (14), an inner sheet (73) unitarily connected to portions of said outer sheet (72) remote from said unpadded foot panel (71) and being secured to portions of said outer sheet (72) of said padded foot panel adjacent said unpadded foot panel (71), a padding material (96) securely disposed between said inner and outer sheets (73, 72) of said padded foot panel, said padded foot panel having opposed first and second side edges (68, 69);

a padded first side panel comprising an outer sheet (82) unitarily connected to the unpadded first side panel (81) for extending substantially vertically upwardly beyond the mattress (14), an inner sheet (83) unitarily connected to portions of said outer sheet (82) remote from said unpadded first side panel (81) and being secured to portions of said outer sheet (82) of said padded first side panel adjacent said unpadded first side panel (81), a padding material (97) securely disposed between said inner and outer sheets (82, 83) of said padded first side panel, said padded first side panel having opposed head and foot edges (78, 79) securely connected to the first side edges (58, 68) of the respective padded head and foot panels;

a padded second side panel comprising an outer sheet (92) unitarily connected to the unpadded second side panel (91) for extending substantially vertically upwardly beyond the mattress (14), an inner sheet (93) unitarily connected to portions of said outer sheet (92) remote from said unpadded second side panel (91) and being secured to portions of said outer sheet (92) of said padded second side panel adjacent said unpadded second side panel (91), a padding material (98) securely disposed between said inner and outer sheets (92, 93) of said padded second side panel, said padded second side panel having opposed head and foot edges (88, 89) securely connected to the second side edges (59, 69) of the respective padded head and foot panels:

attachment means (105, 110, 111) permanently secured to at least the padded first and second side panels for releasable connection to the crib (12); and whereby no gaps exist between the unpadded Panels (61, 71, 81, 91) and the padded panels in proximity to the head, foot and sides (16, 18, 20, 22) of the crib (12), and whereby no gaps exist between adjacent padded panels at locations in proximity to corners of the crib (10) where the respective head and foot panels join to the respective side panels, and whereby outer surfaces of said crib bumper assembly (10) define a unitary appearance extending upwardly from the spring (24) to portions of said crib bumper assembly (10) furthest above said spring (24).

2. The crib bumper assembly of claim 1, wherein the attachment means comprise ties (110) permanently secured to the padded panels and releasably engageable with the crib (12).

3. The crib bumper assembly of claim 1, wherein the attachment means comprise a plurality of flaps (110), each said flap (110) having a first end permanently secured to a padded panel of said crib bumper assembly (10) and having a free end with releasable engagement means (111) for attachment to said padded panel of said crib bumper assembly (10).

4. The crib bumper assembly (10) of claim 1, wherein each of said unpadded head, foot and side panels includes an outer sheet (61, 71, 81, 91) extending unitarily from the portion of said bottom panel (52) to the unitary connection of the outer sheet (62, 72, 82, 92) of the respective one of the padded head, foot and side panels, said unpadded head, foot and side panels further comprising an inner sheet (64, 74, 84, 94) extending unitarily from the inner sheet (63, 73, 83, 93) of a respective one of the padded head, foot and side panels, portions of said inner sheet (64, 74, 84, 94) of the respective unpadded panels being secured to the bottom panel (52).

5. The crib bumper assembly (10) of claim 1, wherein each of said side panels (77, 87) includes a plurality of releasable attachment means secured in face-to-face engagement to selected locations on the outer sheets (82, 92) of the respective padded side panels, each of said side panels (77, 97) further having a flap (110), each said flap (110) having a first end secured in face-to-face engagement to the outer sheet (82, 92) of the respective padded side panel at a location spaced from the releasable attachment means, each said flap (110) further having a free end with a mating attachment means (111) for releasable connection to the releasable attachment means secured to the respective outer sheet (82, 92) of the side panel (77, 87), whereby portions of each said flap (110) between the opposed ends thereof are wrappable around selected structure on the sides of the crib (110), and whereby the mateable releasable attachment means (111) on each said flap (110) is engageable with the corresponding one of the attachment means on the outer sheet (82, 92) of the respective padded side panel for releasably securing said padded side panels to said crib (12) in a substantially vertical orientation extending upwardly from the mattress (14), such that said ends of said flap (110) are substantially parallel to the respective outer sheets (82, 92) of the padded side panels.

* * * * *